US007395010B2

(12) United States Patent
Miyaji

(10) Patent No.: US 7,395,010 B2
(45) Date of Patent: Jul. 1, 2008

(54) IMAGE FORMING APPARATUS THAT PERMITS ADJUSTMENT OF A DISTANCE BETWEEN A LIGHT SOURCE AND A PHOTOCONDUCTOR

(75) Inventor: Shinki Miyaji, Osaka (JP)

(73) Assignee: Kyocera Mita Corporation (JP)

( * ) Notice: Subject to any disclaimer, the term of this patent is extended or adjusted under 35 U.S.C. 154(b) by 319 days.

(21) Appl. No.: 11/288,528

(22) Filed: Nov. 29, 2005

(65) Prior Publication Data

US 2006/0115296 A1 Jun. 1, 2006

(30) Foreign Application Priority Data

Nov. 29, 2004 (JP) ..... 2004-344168

(51) Int. Cl.
*G03G 21/06* (2006.01)

(52) U.S. Cl. ..... 399/128; 399/186

(58) Field of Classification Search ..... 399/127, 399/128, 186, 187
See application file for complete search history.

(56) References Cited

U.S. PATENT DOCUMENTS 5,065,188 A * 11/1991 Kobayashi et al. ..... 399/186
6,658,225 B2 * 12/2003 Thompson et al. ..... 399/128
6,678,491 B2 * 1/2004 Kido et al. ..... 399/128

FOREIGN PATENT DOCUMENTS

JP 8-272270 10/1996

* cited by examiner

*Primary Examiner*—William J Royer
(74) *Attorney, Agent, or Firm*—Gerald E. Hespos; Anthony J. Casella

(57) ABSTRACT

An image forming apparatus has a charge removing unit (31) between a transfer roller (11) for transferring a toner image from a surface of a photosensitive drum (4) to a transfer member and a charging unit (3) for electrostatically charging the surface of the photosensitive drum (4) approximately uniformly, with respect to a rotation direction of the photosensitive drum (4). The charge removing unit (31) includes LEDs (311) to irradiate the surface of the photosensitive drum (4) with charge-removing light. A support (312) supports the LEDs (311) approximately in a line along an axial direction of the photosensitive drum (4). A position setting mechanism (313) allows a position of the support (312) to be changed selectively in a direction orthogonal to the axis of the photosensitive drum (4). Thus, the image forming apparatus can suppress uneven charge-distribution in the axial direction of the photosensitive drum (4).

7 Claims, 8 Drawing Sheets

FIG.4

| ⊿L(=\|L6−L1\|,\|D2−D1\|) | 0.5mm | 1.0mm | 1.5mm | 2mm |
|---|---|---|---|---|
| \|V6−V1\| | 10V | 20V | 30V | 40V |
| \|V02−V01\| | 47V | 90V | 110V | – |

IMAGE FORMING APPARATUS THAT PERMITS ADJUSTMENT OF A DISTANCE BETWEEN A LIGHT SOURCE AND A PHOTOCONDUCTOR

BACKGROUND OF THE INVENTION

1. Field of the Invention

The present invention relates to an image forming apparatus, such as a copying machine, a facsimile machine or a printer.

2. Description of the Related Art

Heretofore, a device for electrostatically charging a drum-type electrophotographic photoconductor or photosensitive body (hereinafter referred to as "photosensitive drum" for brevity) has been composed of a corona charging device designed to expose a surface of a photosensitive drum to corona discharge so as to electrostatically charge the surface. Late years, from the aspect of advantages in lower-level ozone formation and lower power consumption as compared with the corona charging device, a contact charging device designed to bring a charging member in a voltage-applied state into contact with a surface of a photosensitive drum so as to electrostatically charge the surface has come into practical use.

Further, in place of selenium or OPC (Organic Photo Conductor) conventionally used as a material for a surface layer of a photosensitive drum, amorphous silicon is recently beginning to be used in view of environmental concerns, longer life duration, etc.

While amorphous silicon has excellent properties, it has difficulty in being formed as a homogeneous or uniform film due to its production process. Thus, a surface layer of a photosensitive drum formed of such a film is likely to have a locally uneven charge storage capacity which causes an uneven electrostatically-charged state in an axial direction of the photosensitive drum (hereinafter referred to as "axially uneven charge-distribution"), for example, a phenomenon that one end of the photosensitive drum is easily charged and the other end is hardly charged.

As one of measures for suppressing the axially uneven charge-distribution, there has been proposed a technique of providing on an upstream side of a contact charging device a charge removing device for exposing a surface of a photosensitive drum to light to perform a charge removal operation, and adjusting a width of a light path between a light source of the charge removing device and the surface of the photosensitive drum, in an width direction of the photosensitive drum, so as to control the distribution of charge-removing light intensity in the width direction of the photosensitive drum (see Japanese Patent Laid-Open Publication No. 08-272270).

The above technique will be described in more detail with reference to FIGS. 8A and 8B, wherein FIG. 8A is a top plan view of the charge removing device 30, viewing from the side of the photosensitive drum 4, and FIG. 8B is a side view of the charge removing device 30 and the photosensitive drum 4. The charge removing device 30 comprises a plurality of point light sources 301 each consisting of a LED (Light Emitting Diode), a support member 302 supporting the point light sources 301 in a line arrangement, and a pair of plate-shaped members 303 disposed in a gap between the point light sources 301 and the photosensitive drum 4 and adapted to adjust a width of a light path extending from the point light sources 301 to the photosensitive drum 4. In this technique based on adjustment of the light-path width, even a slight change of the light-path width has great impact on the distribution of charge-removing light intensity, and it is practically difficult to adequately adjust the light-path width in such a manner as to obtain a desired distribution of charge-removing light intensity. Consequently, it is likely that the photosensitive drum 4 is not electrostatically charged with sufficient uniformity (or axially uneven charge-distribution occurs).

SUMMARY OF THE INVENTION

In view of the above circumstances, it is an object of the present invention to provide an image forming apparatus capable of suppressing an uneven charge-distribution in a direction of a rotational axis of a photoconductor.

In order to achieve this object, the present invention provides an image forming apparatus adapted to perform an operation for forming an electrostatic latent image on a surface of a photoconductor supported rotatably about a longitudinal axis thereof, attaching toner onto the electrostatic latent image to form a toner image, and transferring the toner image onto a transfer member to form a printed image thereon. The image forming apparatus comprises: charging means disposed on an upstream side of a position for forming the electrostatic latent image, with respect to a rotation direction of the photoconductor, and adapted to electrostatically charge the surface of the photoconductor approximately uniformly; transfer means for transferring the toner image from the surface of the photoconductor to a transfer member; and charge removing means provided with a light source for emitting given charge-removing light therefrom, and adapted to irradiate the surface of the photoconductor with the charge-removing light from the light source, at a position between the transfer means and the charging means with respect to the rotation direction of the photoconductor, so as to perform a charge removal operation. The charge removing means is designed to allow a distance between the light source and the surface of the photoconductor to be adjusted.

In the above image forming apparatus of the present invention, before the operation for forming an electrostatic latent image, the surface of the photoconductor is electrostatically charged in an approximately uniform manner by the charging means disposed on the upstream side of the position for forming the electrostatic latent image, with respect to the rotation direction of the photoconductor. Then, after the operation for attaching toner onto the electrostatic latent image to form a toner image, the transfer means transfers the toner image from the surface of the photoconductor to a transfer member. Then, the charge removing means irradiates the surface of the photoconductor with the charge-removing light from the light source, at the position between the transfer means and the charging means with respect to the rotation direction of the photoconductor, so as to perform the charge removal operation. The distance between the light source and the surface of the photoconductor during the charge removal operation can be adjusted by the charge removing means.

In the charge removal operation, when the distance between the light source of the charge removing means and the surface of the photoconductor is increased, a charge removal effect of the charge removing means is deteriorated so as to allow the surface of the photoconductor to be electrostatically charged in a more facilitated manner. Conversely, when the distance between the light source of the charge removing means and the surface of the photoconductor is reduced, the charge removal effect of the charge removing means is enhanced so as to make it hard for the surface of the photoconductor to be electrostatically charged. Thus, an uneven charge-distribution in the rotation direction of the photoconductor can be suppressed through the above adjustment of the distance between the light source of the charge removing means and the surface of the photoconductor.

BRIEF DESCRIPTION OF THE DRAWINGS

FIG. 4 is a table showing one example of the result of a comparison between respective characteristics of the charge removing unit in FIG. 3 and a charge removing device in FIGS. 8A and 8B.

DETAILED DESCRIPTION OF THE PREFERRED EMBODIMENTS

Figure 1:
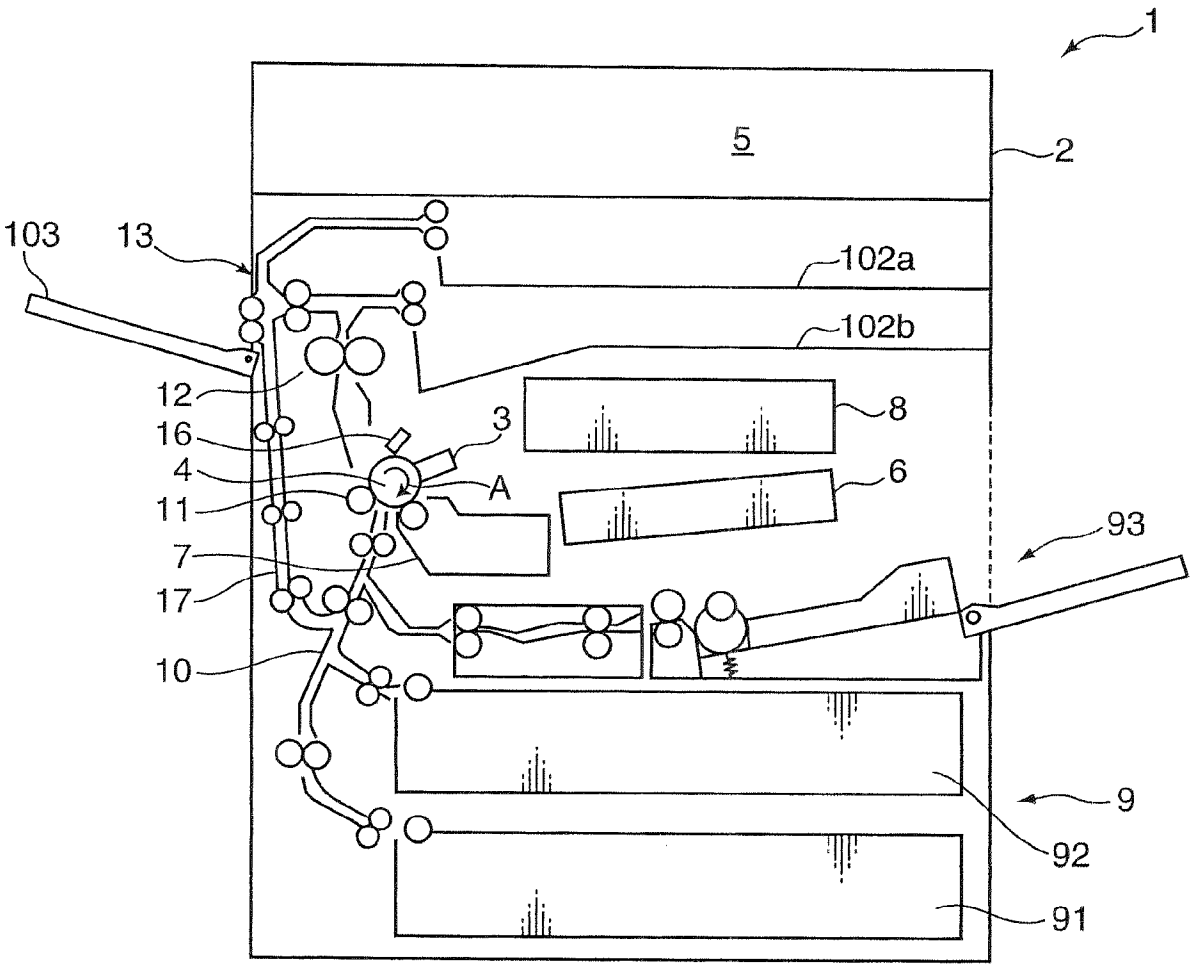
FIG. 1 is a schematic diagram generally showing an image forming apparatus according to one embodiment of the present invention.

With reference to the drawings, an image forming apparatus according to one embodiment of the present invention will now be described. FIG. 1 is a schematic diagram generally showing the image forming apparatus according to the embodiment of the present invention. While the following description will be made in connection with one example where the image forming apparatus is a copying machine 1, it is understood that the image forming apparatus may be any other type (e.g. a facsimile machine, a printer or a scanner).

As shown in FIG. 1, the copying machine 1 comprises: a photosensitive drum 4 designed to be rotated in a direction indicated by the arrow A in this figure; a charging unit 3 (serving as charging means) for electrostatically charging a surface of the photosensitive drum 4 approximately uniformly; a document read unit 5 for reading an image formed on a document, and creating image data; an exposure unit 6 composed, for example, of a laser scanning unit for forming an electrostatic latent image corresponding to the document image on the surface of the photosensitive drum 4 by means of a laser beam; a development unit 7 for attaching a developer (hereinafter referred to as "toner") onto the formed electrostatic latent image to form a toner image; a toner container 8 for supplying toner to the development unit 7; a sheet-feed mechanism 9 for feeding a sheet toward the photosensitive drum 4 with the toner image formed thereon, through a first sheet-carrying passage 10; and a transfer roller 11 (serving as transfer means) for transferring the toner image formed on the surface of the photosensitive drum 4 to the sheet.

The document read unit 5 is a so-called scanner section for scanning an image of a document to obtain image data. The document read unit 5 includes: a contact glass (platen glass) composed of a transparent member made of glass or the like, and adapted to allow a document to be placed thereon; a mirror unit composed of an integrated combination of an exposure lamp serving as a light source for irradiating the document with light, and a mirror for reflecting a reflected light from the document; a group of lenses for focusing a reflected light from the mirror unit; and a CCD image sensor composed of an image pickup device (CCD: Charge Coupled Device) for subjecting a light image formed by focusing the reflected light through the group of lenses, to photoelectric conversion, to obtain image data.

The copying machine 1 further comprises: a fixing unit 12 including a pair of fixing rollers for separating the sheet with the toner image transferred thereonto, from the photosensitive drum 4, and fixing the toner image onto the sheet; a second sheet-carrying passage 13 for selecting a carrying direction using a sorting member to carry the sheet passing through the fixing unit 12, in a sorted manner; a third sheet-carrying passage 17 for carrying the sheets during a double-face copying operation; and upper, lower and additional sheet trays 102*a*, 102*b*, 103 for stocking discharged sheets.

The sheet-feed mechanism 9 has a detachable structure relative to a copying-machine body 2, and includes two sheet-feed cassettes 91, 92 and a stack bypass (bypass tray) 93. Each of the sheet-feed cassettes 91, 92 and the stack bypass 93 are connected to an image forming section including the photosensitive drum 4 and the development unit 7.

Figure 2:
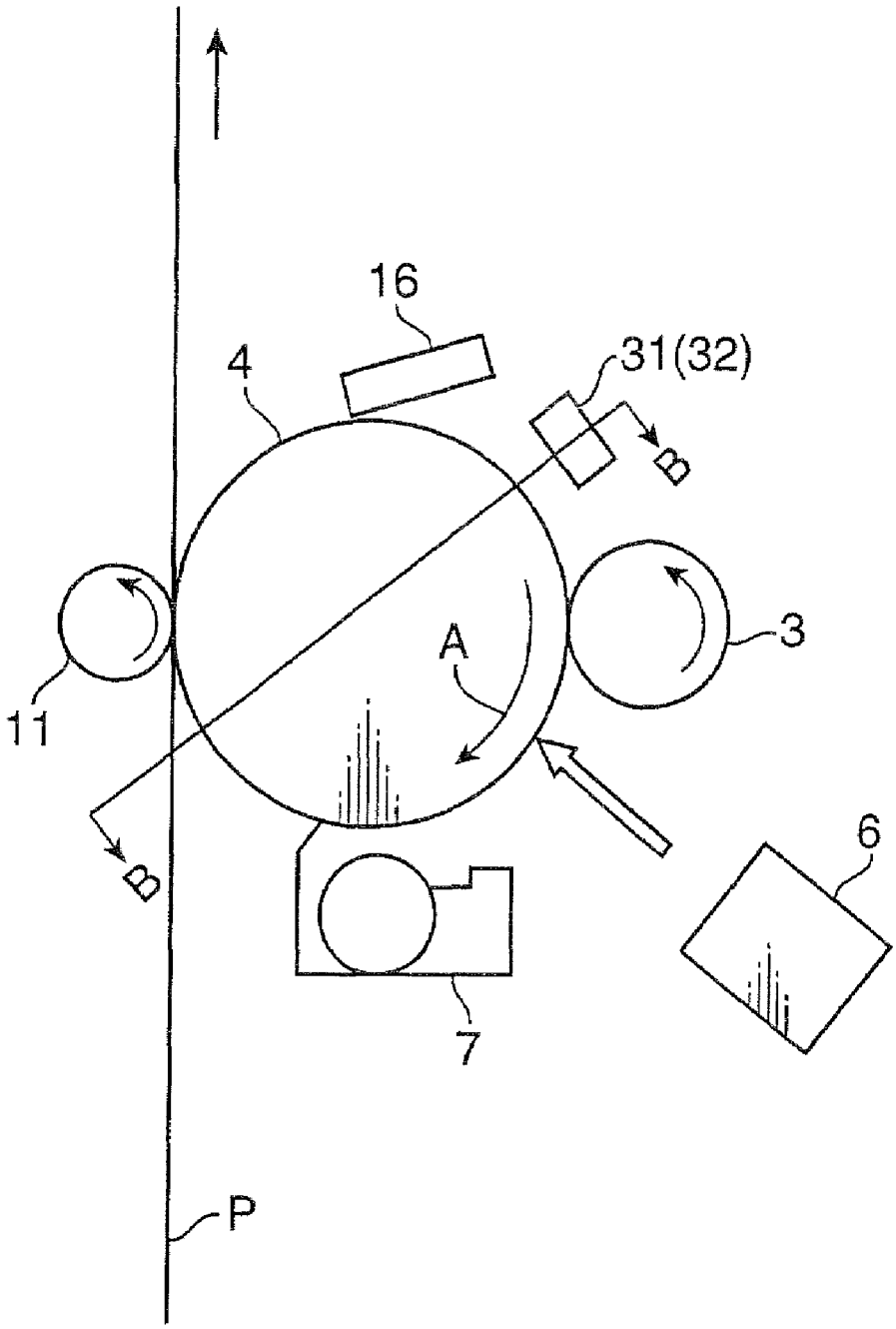
FIG. 2 is a schematic diagram generally showing an image forming section in the image forming apparatus.

FIG. 2 is a schematic diagram showing the image forming section of the copying machine 1. In order to form a printed image on a copy sheet P, the image forming section is provided with the charging unit 3, the photosensitive drum 4, the exposure unit 6, the development unit 7, the transfer roller 11, a cleaning blade 16 which is disposed on an upstream side of the charging unit 3 and on a downstream side of the transfer roller 11 with respect to the rotation direction of the photosensitive drum 4 indicated by the arrow A and adapted to remove toner attached on the surface of the photosensitive drum 4 after the transfer operation, and a charge removing unit 31 (serving as charge removing means) for removing charges on the surface of the photosensitive drum 4 by means of light exposure.

The charging unit 3 is operable to electrostatically charge the surface of the photosensitive drum 4 in an approximately uniform manner through a contact charging process. More specifically, the charging unit 3 comprises a charging roller which has a core, an electrically conductive layer formed on an outer peripheral surface of the core and a resistive layer formed on an outer peripheral surface of the conductive layer, and a power supply (not shown) for applying a given voltage (a voltage formed by superimposing a DC voltage on an AC voltage, in this embodiment) to the charging roller.

The photosensitive drum 4 comprises a drum base made of aluminum to have a diameter of 30 mm, and a photoconductive layer made of positively-charged amorphous silicon and formed on the drum base. The photosensitive drum 4 is designed to be rotatably driven in the direction indicated by the arrow A at a given circumferential speed (e.g. 175 mm/sec).

The exposure unit 6 includes a LED print head (having a given number of pixels, for example 7168 pixels, in a scan line direction) disposed on the downstream side of the charging unit 3. The exposure unit 6 is operable to irradiate the surface or outer peripheral surface of the photosensitive drum 4 with laser light from the LED print head so as to form an electrostatic latent image thereon.

The development unit 7 is operable to attach toner onto the electrostatic latent image formed on the surface of the photosensitive drum 4 by the exposure unit 6, so as to form a toner image. In this embodiment, the development is performed through a monochrome, single-component, jumping development process.

The cleaning blade 16 is operable to mechanically rip off extraneous substances, such as toner attached on the surface of the photosensitive drum 4 during the development operation and left on the surface of the photosensitive drum 4 after the transfer operation (un-transferred residual toner), so as to perform a cleaning operation.

The charge removing unit 31 is operable to irradiate the surface of the photosensitive drum 4 with charge-removing light emitted from a plurality of after-mentioned charge-removing LEDs (charge-removing LEDs 311 in FIG. 3) so as to remove charges on the surface of the photosensitive drum 4, such as the electrostatic latent image formed on the surface of the photosensitive drum 4 by the exposure unit 6.

Figure 3:
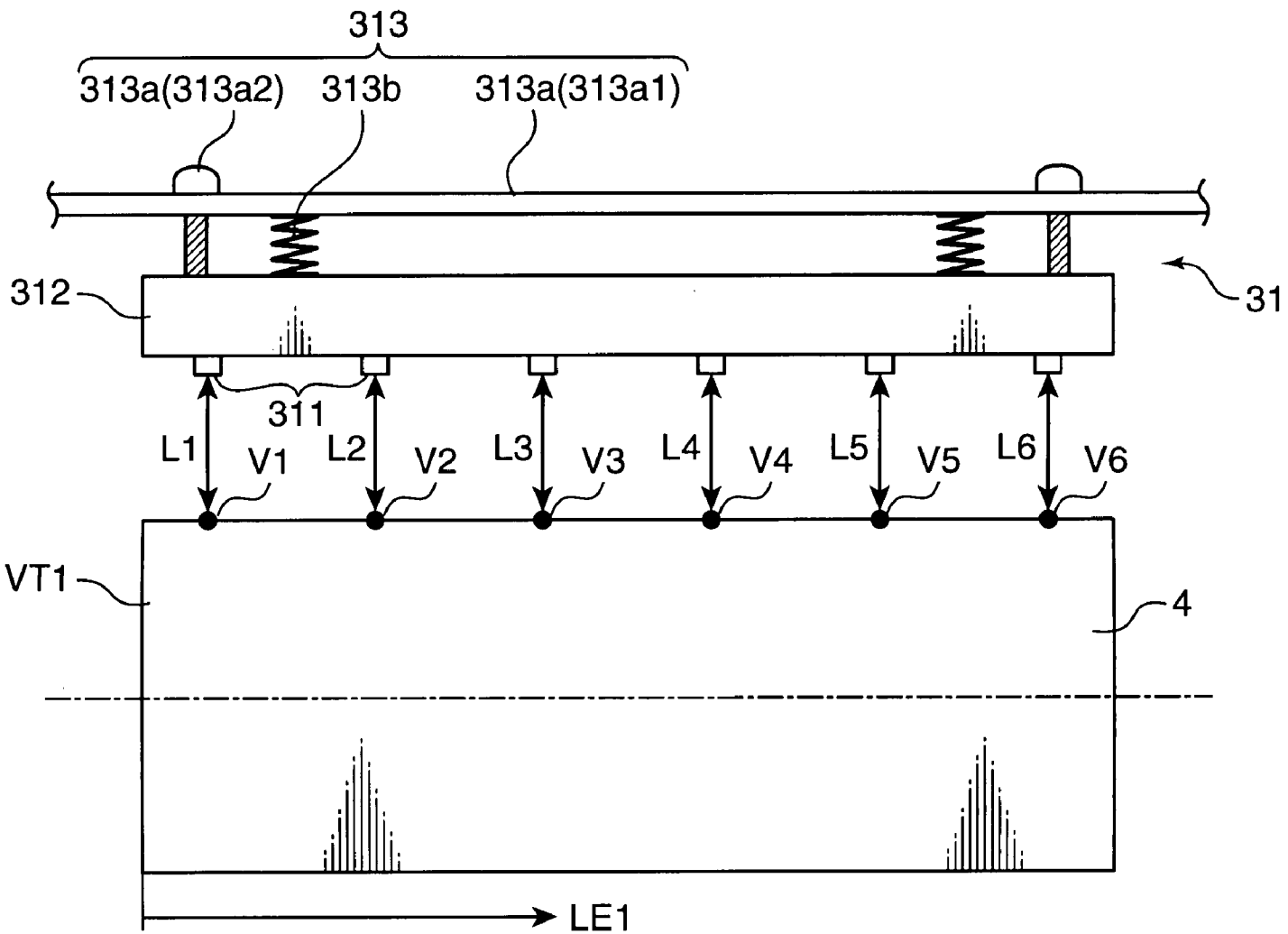
FIG. 3 is a schematic diagram generally showing a charge removing unit in the image forming apparatus (a sectional view taken along the line B-B in FIG. 2).

FIG. 3 is a schematic diagram showing the charge removing unit 31 in the image forming section (a sectional view taken along the line B-B in FIG. 2). The charge removing unit 31 comprises a plurality (six in this embodiment) of charge-removing LEDs 311 (serving as a plurality of spot light sources) each adapted to emit charge-removing light therefrom, a support member 312 supporting the plurality of charge-removing LEDs 311 in such a manner that they are aligned approximately in a line along an axial direction of the photosensitive drum 4, and a position setting mechanism 313 for holding the support member 312 in such a manner as to allow a position of the support member 312 to be selectively changed in a direction orthogonal to the axis of the photosensitive drum 4.

The position setting mechanism 313 includes a positioning member 313*a* for positioning the support member 312 in the direction orthogonal to the axis of the photosensitive drum 4, and a biasing member 313*b* for biasing the support member 312 in a direction allowing the support member 312 to come close to the axis of the photosensitive drum 4. The positioning member 313*a* includes a beam 313*a*1 fixed to the photosensitive drum 4, and a given number (two in this embodiment) of bolts 313*a*2 each having one end fixed to the beam 313*a*1 and the other end threadingly attached to the support member 312 at a given position (a corresponding one of opposite ends of the support member 312, in this embodiment). The biasing member 313*b* includes a given number (two in this embodiment) of springs 313*b* compressedly interposed between the beam 313*a*1 and the support member 312.

The beam 313*a*1 is positionally fixed relative to the photosensitive drum 4 in such a manner as to be located at a position approximately parallel to the axis of the photosensitive drum 4 and spaced apart from the axis of the photosensitive drum 4 by a given distance. In this embodiment, the photosensitive drum 4 includes a rotating shaft having opposite ends each rotatably attached to a stationary housing at a given position. The beam 313*a*1 has opposite ends each fixed to the housing at a given position.

When each of the bolts 313*a*2 is turned clockwise (or counterclockwise), the support member 312 is moved in a direction allowing the support member 312 to come close to (or come away from) the axis of the photosensitive drum 4 and set at a given position, while being biased in a direction coming close to the axis of the photosensitive drum 4 by the two springs 313*b* compressedly interposed between the beam 313*a*1 and the support member 312.

As above, this positioning operation based on the turning position of at least one of the bolts 313*a*2 is performed while biasing the support member 312 by the springs 313*b*. Thus, even if there is some play (clearance) between the bolt 313*a*2 and a bolt hole (not shown) formed in the support member 312 and threadingly engaged with the bolt 313*a*2, the support member 312 can be accurately positioned. While the springs 313*b* in this embodiment are arranged to bias the support member 312 in the direction allowing the support member 312 to come close to the axis of the photosensitive drum 4, it may be designed to bias the support member 312 in the direction allowing the support member 312 to come away from the axis of the photosensitive drum 4.

Figure 8A:
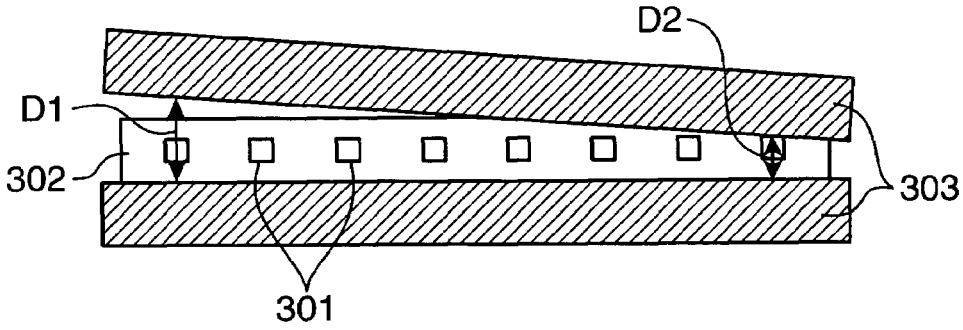
PRIOR ART FIG.8A
FIGS. 8A and 8B are schematic diagrams showing one example of a conventional charge removing device.
Figure 8B:
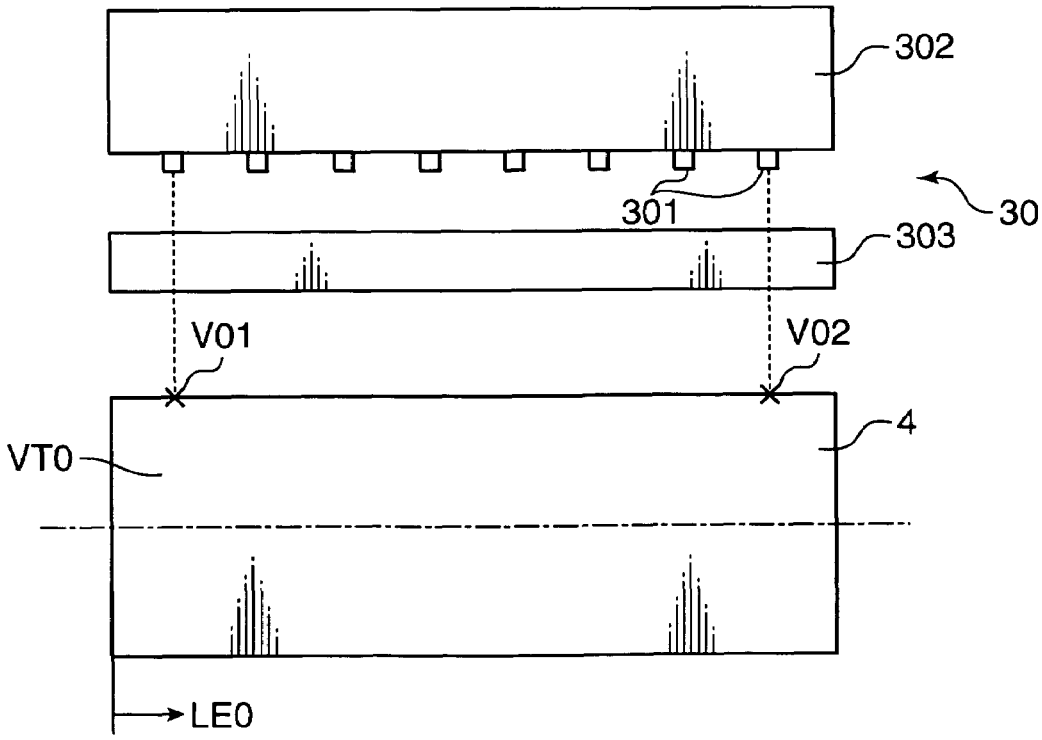
PRIOR ART FIG.8B

FIG. 4 is a table showing the result of a comparison between respective characteristics of the charge removing unit 31 illustrated in FIG. 3 and the conventional charge removing device 30 illustrated in FIGS. 8A and 8B. In the charge removing unit 31 in FIG. 3, when left and/or right bolt 313*a*2 (in FIG. 3) is turned, distances L1 to L6 between respective charge-removing LEDs 311 and the surface of the photosensitive drum 4 can be effectively adjusted. Exceptionally, in the charge removing unit 31, when the support member 312 is set to be located to a position parallel to the axis of the photosensitive drum 4, each of the distances L1 to L6 has the same value. Further, in a surface potential VT1 of the photoconductive drum 4, each of potentials V1 to V6 at positions opposed, respectively, to the six charge-removing LEDs 311, has the same value, when the support member 312 is set to be located parallel to the axis of the photosensitive drum 4 (That is, each of the charge-removing LEDs 311 emits charge-removing light having the same intensity and frequency).

In the charge removing device 30 illustrated in FIGS. 8A and 8B, each of widths D1, D2 of a light path from the leftmost or rightmost one of the LEDs 301 to the photosensitive drum 4 can be adjusted. Further, in a surface potential VT0 of the photosensitive drum 4, each of potentials V01, V02 at positions opposed, respectively, to the leftmost or rightmost one of the LEDs 301 has the same value, when the light-path width is set at a constant value (the plate-shaped members 303 are set to be located parallel to one another (That is, each of the LEDs 301 emits charge-removing light having the same intensity and frequency).

The upper column of FIG. 4 shows an absolute value ΔL of a difference between the distance L1 and the distance L6 in the charge removing unit 31 illustrated in FIG. 3 or an absolute value ΔL of a difference between the light-path width D1 and the light-path width D2 in the charge removing device 30 illustrated in FIG. 8. The intermediate and lower columns of FIG. 4 show, respectively, an absolute value of a difference between the potential V1 and the potential V6 in the charge removing unit 31 illustrated in FIG. 3 and an absolute value of a difference between the potential V01 and the potential V02 in the charge removing device 30 illustrated in FIG. 8.

As seen in FIG. 4, the sensitivity of change in the potential VT0 to change in the difference between the light-path widths D1, D2 in the charge removing device 30 illustrated in FIG. 8 is about four times greater than the sensitivity of change in the potential VT1 to change in the difference between the distances L1 and L6 in the charge removing device 30 illustrated in FIG. 8. This verifies that the operation for adjusting the distances L1 to L6 can be easily performed as compared with the operation for adjusting the light-path widths D1, D2.

Figure 5:
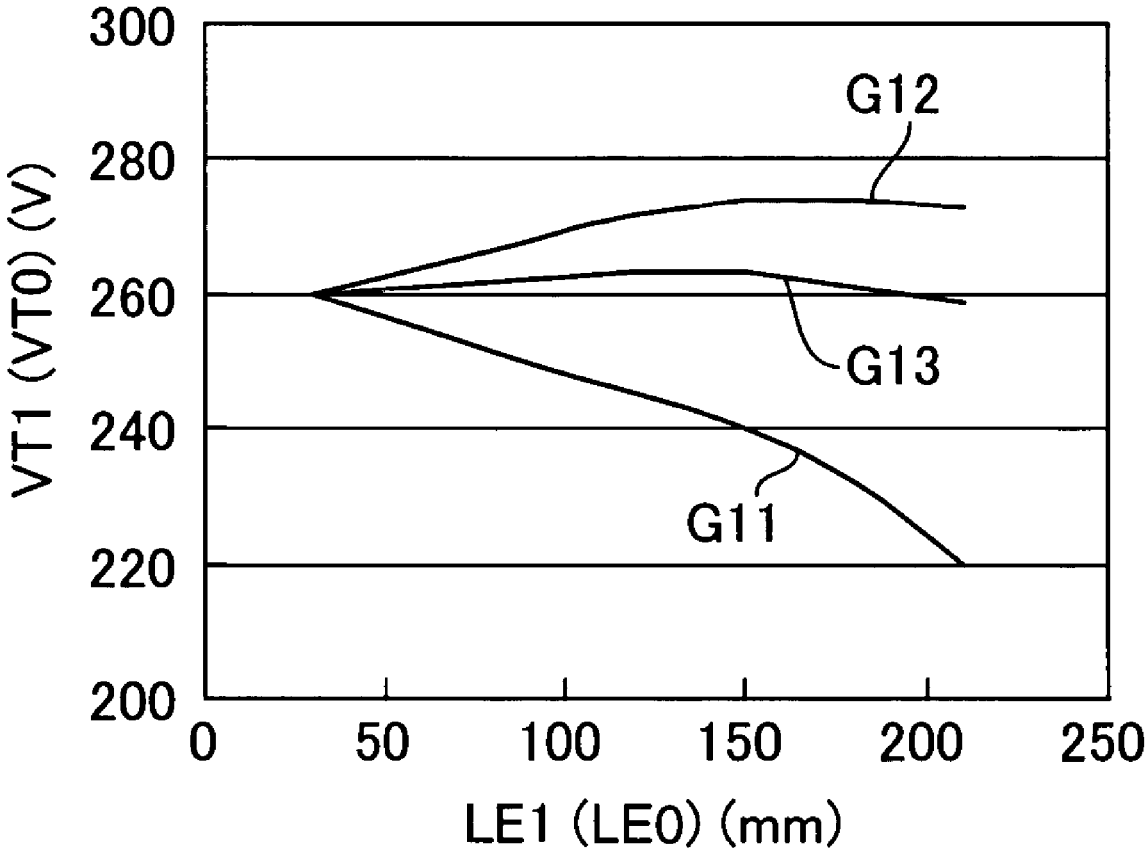
FIG. 5 is a graph showing one example of the result of respective adjustments using the charge removing unit in FIG. 3 and the charge removing device in FIGS. 8A and 8B.

FIG. 5 is a graph showing one example of the result of respective adjustments using the charge removing unit 31 in FIG. 3 and the charge removing device 30 in FIGS. 8A and 8B. In FIG. 5, the horizontal axis represents a distance LE0, LE1 from one end of the photosensitive drum 4 (see FIG. 8, FIG. 3), and the vertical axis represents a surface potential VT0, VT1 of the photosensitive drum 4. The curve G11 shows a potential VT0, VT1 before the adjustment. The curve G12 shows a potential VT0 after the adjustment using the charge removing device 30 in FIGS. 8A and 8B, and the curve G13 shows a potential VT1 after the adjustment using the charge removing unit 31 in FIG. 3.

As seen in the curve G11, the potential VT0, VT1 before the adjustment is a downward-sloping curve, and a potential difference of about 40 V occurs between the opposite ends of the photosensitive drum 4. As seen in the curve G12, the potential VT0 after the adjustment using the charge removing device 30 in FIGS. 8A and 8B is an upward-sloping curve, and a potential difference of about 15 V remains between the opposite ends of the photosensitive drum 4. In contrast, as seen in the curve G13, the potential VT1 after the adjustment using the charge removing unit 31 in FIG. 3 is an approximately horizontal line, and almost no potential difference remains between the opposite ends of the photosensitive drum 4. Thus, the adjustment using the charge removing unit 31 makes it possible to reduce a difference in surface potential of the photosensitive drum 4.

As described above, when each of the distances L1 to L6 between the respective charge-removing LEDs 311 of the charge removing unit 31 and the surface of the photosensitive drum 4 is increased, a charge removal effect of the charge removing unit 31 is deteriorated so as to allow the surface of the photosensitive drum 4 to be electrostatically charged in a more facilitated manner. Conversely, when each of the distances L1 to L6 between the respective charge-removing LEDs 311 of the charge removing unit 31 and the surface of the photosensitive drum 4 is reduced, the charge removal effect of the charge removing unit 31 is enhanced so as to make it hard for the surface of the photosensitive drum 4 to be electrostatically charged. Thus, an uneven charge-distribution in the axial direction of the photosensitive drum 4 can be suppressed through the above adjustment of the distances L1 to L6 between the respective charge-removing LEDs 311 of the charge removing unit 31 and the surface of the photosensitive drum 4.

Further, the position setting mechanism 313 can be adjusted to change the position of the support member 312 in the direction orthogonal to the axis of the photosensitive drum 4. This makes it possible to readily change the distances L1 to L6 between the plurality (six in this embodiment) of charge-removing LEDs 311 supported by the support member 312 and the surface of the photosensitive drum 4.

Furthermore, the operation for positioning the support member 312 is performed while biasing the support member 312 in the direction allowing the support member 312 to come close to the axis of the photosensitive drum 4, by the springs 313*b*. This makes it possible to accurately position the support member 312 (and the charge-removing LEDs 311 supported by the support member 312).

In addition, the beam 313*a*1 fixed to the photosensitive drum 4 is connected to the support member 312 at a given position thereof through the bolts 313*a*2, and the support member 312 is biased in the direction allowing the support member 312 to come close to the axis of the photosensitive drum 4, by the springs 313*b* compressedly interposed between the beam 313*a*1 and the support member 312. This makes it possible to provide each of the position setting mechanism 313 and the biasing member 313*b* in a simplified structure.

The present invention may be implemented in the following forms.

(A) While the above embodiment has been described in connection with one example where the image forming apparatus is the copying machine 1, the present invention may be applied to any other type of image forming apparatus (e.g. a facsimile machine or a printer).

(B) While the above embodiment has been described in connection with one example where the light source of the charge removing unit 31 is the charge-removing LED 311 as a point light source, any other suitable light source may be used. For example, a line light source comprising an LED, a slit and a lens may be used.

Figure 6:
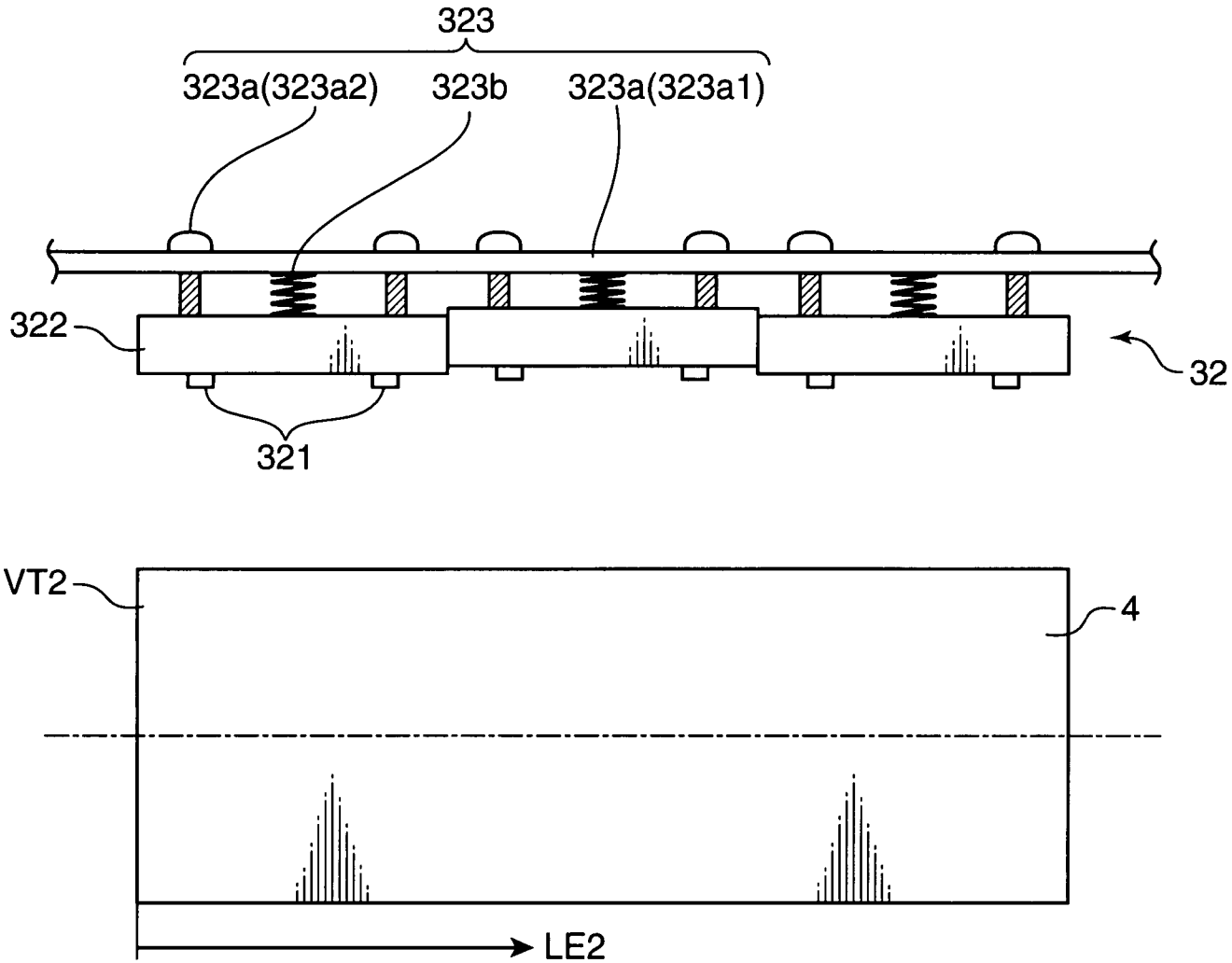
FIG. 6 is a schematic diagram generally showing one modification of the charge removing unit in the image forming apparatus (a sectional view taken along the line B-B in FIG. 2).

(C) While the above embodiment has been described in connection with one example where the support member 312 is formed as a single-piece member, the support member may be composed of a plurality (e.g. three) of divided support portions each supporting at least one (e.g. two) charge-removing LED 311. FIG. 6 is a schematic diagram generally showing one modification of the charge removing unit 32 (a sectional view taken along the line B-B in FIG. 2).

As shown in FIG. 6, this charge-removing unit 32 comprises a plurality of charge-removing LEDs 321 (serving as a plurality of point light sources) each adapted to emit charge-removing light therefrom, a plurality (three in this embodiment) of divided support portions 322 each supporting at least one (two in this embodiment) of the charge-removing LEDs 321 in such a manner as to allow the plurality of the charge-removing LEDs 321 to be aligned approximately in a line along the axial direction of the photosensitive drum 4, and a position setting mechanism 323 for holding each of the divided support portions 322 in such a manner as to allow a position of the divided support portion 322 to be selectively changed in a direction orthogonal to the axis of the photosensitive drum 4.

The position setting mechanism 323 includes a positioning member 323*a* for positioning each of the divided support portions 322 in the direction orthogonal to the axis of the photosensitive drum 4, and a biasing member 323*b* for biasing each of the divided support portions 322 in a direction allowing the divided support portion 322 to come close to the axis of the photosensitive drum 4. The positioning member 323*a* includes a beam 323*a*1 fixed to the photosensitive drum 4, and a given number (six in this embodiment) of bolts 323*a*2 each having one end fixed to the beam 323*a*1 and the other end threadingly attached to a corresponding one of the divided support portions 322 at a given position (one of opposite ends of the divided support portion 322, in this embodiment). The biasing member 323*b* includes a given number of springs 323*b* each compressedly interposed between the beam 323*a*1 and a corresponding one of the divided support portions 322. More specifically, the springs 323*b* are arranged in such a manner that each spring 323*b* is on each divided support portion 322.

The beam 323*a*1 is positionally fixed relative to the photosensitive drum 4 in such a manner as to be located at a position approximately parallel to the axis of the photosensitive drum 4 and spaced apart from the axis of the photosensitive drum 4 by a given distance. The beam 323*a*1 has opposite ends each fixed to a given position of the stationary housing to which the opposite ends of the rotating shaft of the photosensitive drum 4 are rotatably attached.

When each of the bolts 323*a*2 is turned clockwise (or counterclockwise), a corresponding one of the divided support portions 322 is moved in a direction allowing divided support portion 322 to come close to (or come away from) the axis of the photosensitive drum 4 and set at a given position, while being biased in a direction coming close to the axis of the photosensitive drum 4 by a corresponding one of the springs 323*b* compressedly interposed between the beam 323*a*1 and divided support portion 322.

Figure 7:
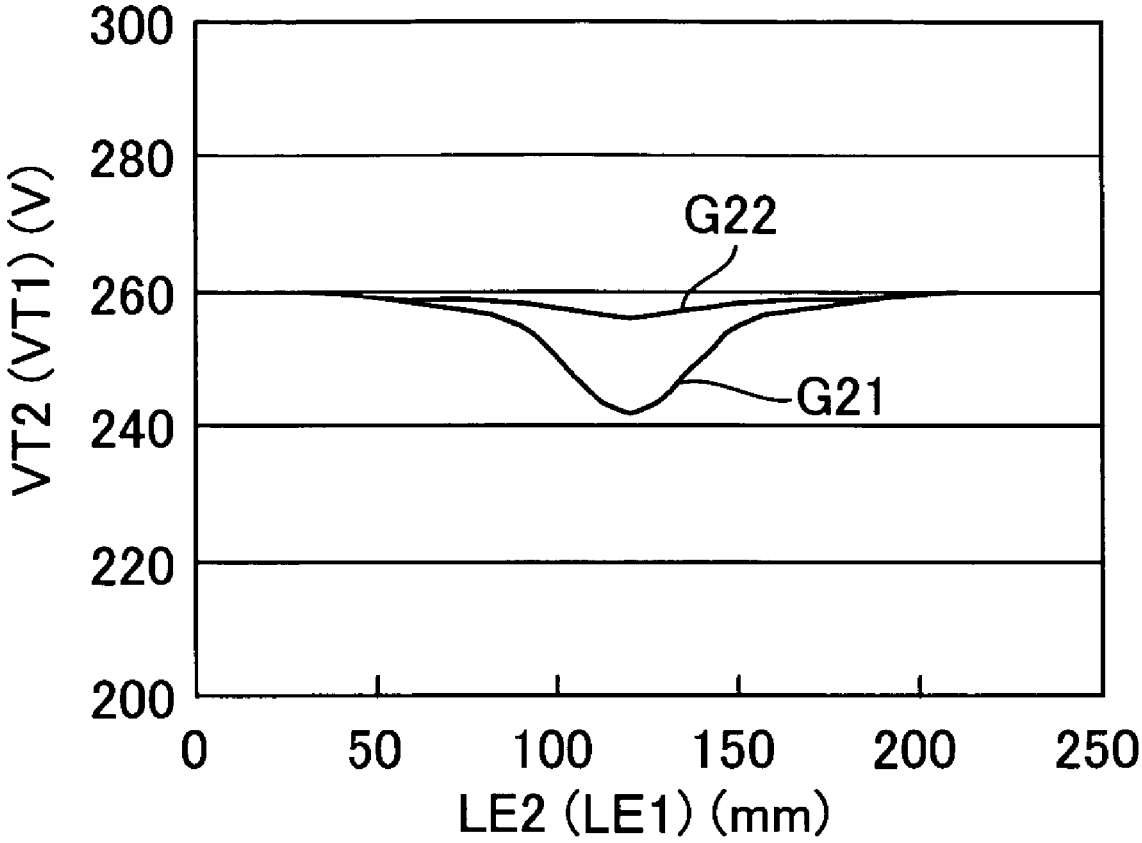
FIG. 7 is a graph showing one example of the result of respective adjustments using the charge removing unit in FIG. 3 and the charge removing unit in FIG. 6.

Thus, a distance between the surface of the photosensitive drum 4 and the two charge-removing LEDs 321 supported by each of the divided support portions 322 can be adjusted independently. This makes it possible to further finely adjust the distance between each of the charge-removing LEDs 321 and the surface of the photosensitive drum 4. FIG. 7 is a graph showing one example of the result of respective adjustments using the charge removing unit 31 in FIG. 3 and the charge removing unit 32 in FIG. 6. In FIG. 7, the horizontal axis represents a distance LE1, LE2 from one end of the photosensitive drum 4 (see FIG. 3, FIG. 6), and the vertical axis represents a surface potential VT1, VT2 of the photosensitive drum 4. The curve G21 shows a potential VT1 after the adjustment using the charge removing unit 31 in FIG. 3, and the curve G22 shows a potential VT2 after the adjustment using the charge removing unit 32 in FIG. 6.

As seen in the curve G21, the potential VT1 after the adjustment using the charge removing unit 31 in FIG. 3 is a curve where an approximately central region is convex downward, and a potential difference of about 20V remains between each of the ends and the central region of the photosensitive drum 4. In contrast, as seen in the curve G22, the potential VT2 after the adjustment using the charge removing unit 32 in FIG. 6 is an approximately horizontal line, and almost no potential difference remains between each of the ends and the central region of the photosensitive drum 4. Thus, the adjustment using the charge removing unit 32 makes it possible to further reduce a difference in surface potential of the photosensitive drum 4.

(D) While the above embodiment has been described in connection with one example where each of the bolts 313*a*2 is manually driven, the charge removing unit 31 may include measurement means for measuring a distribution of the potential VT1 in FIG. 4, and adjustment means for calculating an adjustment value in accordance with the measurement result and automatically adjusting each of the bolts 313*a*2 in accordance with the calculated adjustment value. In this case, the manual adjustment operation can be eliminated.

(E) While the above embodiment has been described in connection with one example where the biasing member 313*b* is composed of the springs 313*b*, any other suitable biasing member having elasticity (e.g. a rubber member having opposite ends connected, respectively, to the beam 313*a*1 and the support member 312) may be used.

(F) While the above embodiment has been described in connection with one example where the positioning member 313*a*1 includes the beam 313*a* and the bolts 312*a*2, any other suitable structure may be used. For example, the positioning member 313*a* may include a hydraulic (or pneumatic) cylinder having a stroke adjusting mechanism. In this case, the positioning operation can be performed more accurately and easily.

(G) While the above embodiment has shown the photosensitive drum 4 as one example of a photoconductor, a belt-shaped photoconductor may be used. In this case, the belt-shaped photoconductor may be rotatably supported by a given driving system including a driving roller and a driven roller, and rotatably (circulatingly) driven by the driving roller. This structure may be designed such that the support member may support a plurality of point light sources in such a manner that they are aligned approximately in a line along a rotational axis of the driving roller (which corresponds to a rotational axis of the belt-shaped photoconductor), and the position of the support member be selectively changed in a direction orthogonal to the rotational axis.

As mentioned above, the copying machine 1 (image forming apparatus) comprises: the charging unit 3 disposed on an upstream side of the position for forming an electrostatic latent image, with respect to a rotation direction of the photosensitive drum 4, and adapted to electrostatically charge the surface of the photosensitive drum 4 approximately uniformly; the transfer roller 11 for transferring a toner image from the surface of the photosensitive drum 4 to a transfer member; and the charge removing unit 31 provided with the charge-removing LEDs 311 (point light sources) for emitting charge-removing light therefrom, and adapted to irradiate the surface of the photosensitive drum 4 with the charge-removing light from the charge-removing LEDs 311, at a position between the transfer roller 11 and the charging unit 3 with respect to the rotation direction of the photosensitive drum 4, so as to perform a charge removal operation. The charge removing unit 31 is designed to allow a distance between the charge-removing LEDs 311 and the surface of the photosensitive drum 4 to be adjusted.

In the above copying machine 1, before the operation for forming an electrostatic latent image, the surface of the photosensitive drum 4 is electrostatically charged in an approximately uniform manner by the charging unit 3. Then, after the operation for attaching toner onto the electrostatic latent image to form a toner image, the transfer roller 11 transfers the toner image from the surface of the photosensitive drum 4 to a transfer member. Then, the charge removing unit 31 irradiates the surface of the photosensitive drum 4 with the light from the charge-removing LEDs 311, at the position between the transfer roller 11 and the charging unit 3 with respect to the rotation direction of the photosensitive drum 4, so as to perform the charge removal operation. Further, the distance between the charge-removing LEDs 311 and the surface of the photosensitive drum 4 can be adjusted in the axial direction of the photosensitive drum 4.

In the charge removal operation, when the distance between the charge-removing LEDs 311 of the charge removing unit 31 and the surface of the photosensitive drum 4 is increased, a charge removal effect of the charge removing unit 31 is deteriorated so as to allow the surface of the photosensitive drum 4 to be electrostatically charged in a more facilitated manner. Conversely, when the distance between the charge-removing LEDs 311 and the surface of the photosensitive drum 4 is reduced, the charge removal effect of the charge removing unit 31 is enhanced so as to make it hard for the surface of the photosensitive drum 4 to be electrostatically charged. Thus, an uneven charge-distribution in the rotation direction of the photosensitive drum 4 can be suppressed through the above adjustment of the distance between the charge-removing LEDs 311 of the charge removing unit 31 and the surface of the photosensitive drum 4.

Further, the charge removing unit 31 includes a plural number of the charge-removing LEDs 311 each adapted to emit charge-removing light therefrom, the support member 312 supporting the charge-removing LEDs 311 in such a manner that they are aligned approximately in a line along a direction of the rotational axis of the photosensitive drum 4, and the position setting mechanism 313 for holding the support member 312 in such a manner as to allow the position of the support member 312 to be selectively changed in the direction orthogonal to the rotational axis of the photosensitive drum 4.

In this structure, the support member 312 supports the plurality of the charge-removing LEDs 311 emitting charge-removing light therefrom, in such a manner that they are aligned approximately in a line along the axial direction of the photosensitive drum 4. Further, the position setting mechanism 313 holds the support member 312 in such a manner as to allow the position of the support member 312 to be selectively changed in the direction orthogonal to the axis of the photosensitive drum 4. In this manner, the position of the support member 312 is selectively changed in the direction orthogonal to the axis of the photosensitive drum 4 by the position setting mechanism 313. This makes it possible to readily change the distances between the plurality of charge-removing LEDs 311 supported by the support member 312 and the surface of the photosensitive drum 4.

Further, the position setting mechanism 313 includes the positioning member 313*a* for positioning the support member 312 in the direction orthogonal to the axis of the photosensitive drum 4, and the spring 313*b* for biasing the support member 312 in a direction allowing the support member 312 to come close to the axis of the photosensitive drum 4. Thus, the support member 312 is positioned in the direction orthogonal to the axis of the photosensitive drum 4 by the position setting mechanism 313, and the support member 312 is biased in a direction coming close to the axis of the photosensitive drum 4 by the spring 313*b*. Therefore, the operation for positioning the support member 312 is performed while biasing the support member 312 in the direction allowing the support member 312 to come close to the axis of the photosensitive drum 4, by the spring 313*b*. This provides an advantage of being able to accurately position the support member 312 (and the charge-removing LEDs 311 supported by the support member 312).

This application is based on patent application No. 2004-344168 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus adapted to perform an operation for forming an electrostatic latent image on a surface of a photoconductor supported rotatably about a longitudinal axis thereof, attaching toner onto the electrostatic latent image to form a toner image, and transferring the toner image onto a transfer member to form a printed image thereon, comprising:

charging means disposed on an upstream side of a position for forming said electrostatic latent image, with respect to a rotation direction of said photoconductor, and adapted to electrostatically charge the surface of said photoconductor approximately uniformly;

transfer means for transferring said toner image from the surface of said photoconductor to a transfer member; and charge removing means provided with a light source for emitting given charge-removing light therefrom, and adapted to irradiate the surface of said photoconductor with the charge-removing light from said light source, at a position between said transfer means and said charging means with respect to the rotation direction of said photoconductor, so as to perform a charge removal operation, said charge removing means being designed to allow a distance between said light source and the surface of said photoconductor to be adjusted.

2. The image forming apparatus as defined in claim 1, wherein said light source of said charge removing means comprises a plurality of point light sources each adapted to emit given charge-removing light therefrom, wherein said charge removing means includes:

a support member supporting said plurality of point light sources in such a manner that they are aligned approximately in a line along a direction of the rotational axis of said photoconductor; and a position setting mechanism for holding said support member in such a manner as to allow a position of said support member to be selectively changed in a direction orthogonal to the rotational axis of said photoconductor.

3. The image forming apparatus as defined in claim 2, wherein:

said support member comprises a plurality of divided support portions each having at least one of said plurality of point light source; and said position setting mechanism is designed to hold each of said plurality of divided support portions in such a manner as to allow respective positions of said divided support portions to be selectively changed in the direction orthogonal to the rotational axis of said photoconductor individually.

4. The image forming apparatus as defined in claim 2, wherein said position setting mechanism includes:

a positioning member for positioning said support member in the direction orthogonal to the rotational axis of said photoconductor; and a biasing member for biasing said support member in a direction allowing said support member to come close to the rotational axis of said photoconductor.

5. The image forming apparatus as defined in claim 4, wherein:

said positioning member includes a beam positionally fixed relative to said photoconductor, and a bolt which has one end engaged with said beam and the other end threadingly attached to said support member at a given position; and said biasing member includes a spring compressedly interposed between said beam and said support member.

6. The image forming apparatus as defined in claim 2, wherein each of said plurality of point light sources consists of a LED.

7. The image forming apparatus as defined in claim 1, wherein said photoconductor consists of a photosensitive drum rotatable about a longitudinal axis thereof.

* * * * *